United States Patent [19]

Liebermann

[11] Patent Number: 4,664,176

[45] Date of Patent: May 12, 1987

[54] CASTING IN A THERMALLY-INDUCED LOW DENSITY ATMOSPHERE

[75] Inventor: Howard H. Liebermann, Succasunna, N.J.

[73] Assignee: Allied Corporation, Morris Township, Morris County, N.J.

[21] Appl. No.: 767,248

[22] Filed: Aug. 20, 1985

Related U.S. Application Data

[63] Continuation of Ser. No. 483,474, Apr. 11, 1983, abandoned.

[51] Int. Cl.[4] ..... B22D 11/06

[52] U.S. Cl. ..... 164/463; 164/423; 164/427; 164/475; 164/479; 164/415

[58] Field of Search ..... 164/463, 423, 427, 429, 164/479, 415, 475, 473

[56] References Cited

U.S. PATENT DOCUMENTS

| | | | |
|---|---|---|---|
| 3,861,450 | 1/1975 | Mobley et al. | 164/465 |
| 3,862,658 | 1/1975 | Bedell | 164/423 X |
| 4,142,571 | 3/1979 | Narasimhan | 164/463 |
| 4,154,283 | 5/1979 | Ray et al. | 164/463 |
| 4,202,404 | 5/1980 | Carlson | 164/423 |
| 4,262,734 | 4/1981 | Liebermann | 164/423 |
| 4,282,921 | 8/1981 | Liebermann | 164/463 |
| 4,301,855 | 11/1981 | Suzuki et al. | 164/254 |

*Primary Examiner*—Kuang Y. Lin

*Attorney, Agent, or Firm*—Ernest D. Buff; Gerhard H. Fuchs

[57] ABSTRACT

An apparatus and method for casting metal strip include a moving chill body that has a quench surface. A nozzle mechanism deposits a stream of molten metal on a quenching region of the quench surface to form the strip. The nozzle mechanism has an exit portion with a nozzle orifice. A depletion mechanism heats a gas to lower the density thereof and to produce a low-density atmosphere. The gas is supplied to a depletion region located adjacent to and upstream of the quenching region to provide the low density atmosphere within the depletion region.

11 Claims, 6 Drawing Figures

CASTING IN A THERMALLY-INDUCED LOW DENSITY ATMOSPHERE

This application is a continuation of application Ser. No. 483,474 filed Apr. 11, 1983, now abandoned.

BACKGROUND OF THE INVENTION

1. Field of the Invention

The invention relates to a casting of metal strip directly from a melt, and more particularly to the rapid solidification of metal directly from a melt to form substantially continuous metal strip.

2. Description of the Prior Art

U.S. Pat. No. 4,142,571 issued to M. Narasimhan discloses a conventional apparatus and method for rapidly quenching a stream of molten metal to form continuous metal strip. The metal can be cast in an inert atmosphere or a partial vacuum. U.S. Pat. No. 3,862,658 issued to J. Bedell and U.S. Pat. No. 4,202,404 issued to C. Carlson disclose flexible belts employed to prolong contact of cast metal filament with a quench surface.

The casting of very smooth strip has been difficult with conventional devices because gas pockets entrapped between the quench surface and the molten metal during quenching form gas pocket defects. These defects, along with other factors, cause considerable roughness on the quench surface side as well as the opposite, free surface side of the cast strip. In some cases, the surface defects actually extend through the strip, forming perforations therein.

U.S. Pat. No. 4,154,283 to R. Ray et al. discloses that vacuum casting of metal strip reduces the formation of gas pocket defects. The vacuum casting system taught by Ray et al. requires specialized chambers and pumps to produce a low pressure casting atomosphere. In addition, auxiliary means are required to continuously transport the cast strip out of the vacuum chamber. Further, in such a vacuum casting system, the strip tends to weld excessively to the quench surface instead of breaking away as typically happens when casting in an ambient atmosphere.

U.S. Pat. No. 4,301,855 issued to H. Suzuki et al. discloses an apparatus for casting metal ribbon wherein the molten metal is poured from a heated nozzle onto the outer peripheral surface of a rotary roll. A cover encloses the roll surface upstream of the nozzle to provide a chamber, the atmosphere of which is evacuated by a vacuum pump. A heater in the cover heats the roll surface upstream from the nozzle to remove dew droplets and gases from the roll surface. The vacuum chamber lowers the density of the moving gas layer next to the casting roll surface, thereby decreasing formation of air pocket depressions in the cast ribbon. The heater helps drive off moisture and adhered gases from the roll surface to further decrease formation of air pocket depressions.

The apparatus disclosed by Suzuki et al, does not pour metal onto the casting surface until that surface has exited the vacuum chamber. By this procedure, complications involved in removing a rapidly advancing ribbon from the vacuum chamber are avoided. The ribbon is actually cast in the open atmosphere, offsetting any potential improvement in ribbon quality.

U.S. Pat. No. 3,861,450 to Mobley, et al, discloses a method and apparatus for making metal filament. A disk-like, heat-extracting member rotates to dip an edge surface thereof into a molten pool, and a non-oxidizing gas is introduced at a critical process region where the moving surface enters the melt. This non-oxidizing gas can be a reducing gas, the combustion of which in the atmosphere yields reducing or non-oxidizing combustion products at the critical process region. In a particular embodiment, a cover composed of carbon or grapite encloses a portion of the disk and reacts with the oxygen adjacent the cover to produce non-oxidizing carbon monoxide and carbon dioxide gases which can then surround the disk portion and the entry region of the melt.

The introduction of non-oxidizing gas, as taught by Mobley, et al., disrupts and replaces an adherent layer of oxidizing gas with the non-oxidizing gas. The controlled introduction of non-oxidizing gas also provides a barrier to prevent particulate solid materials on the melt surface from collecting at the critical process region where the rotating disk would drag the impurities into the melt to the point of initial filament solidification. Finally, the exclusion of oxidizing gas and floating contaminants from the critical region increases the stability of the filament release point from the rotating disk by decreasing the adhesion therebetween and promoting spontaneous release.

Mobley, et al., however, addess only the problem of oxidation at the disk surface and in the melt. The flowing stream of non-oxidizing gas taught by Mobley, et al. is still drawn into the molten pool by the viscous drag of the rotating wheel and can separate the melt from the disk edge to momentarily disturb filament formation. The particular advantage provided by Mobley, et al, is that the non-oxidizing gas decreases the oxidation at the actual point of filament formation within the melt pool. Thus, Mobley, et al. fail to minimize the entrainment of gas that could separate and insulate the disk surface from the melt.

U.S. Pat. No. 4,282,921 and U.S. Pat. No. 4,262,734 issued to H. Liebermann disclose an apparatus and method in which coaxial gas jets are employed to reduce edge defects in rapidly quenched amorphous strips. U.S. Pat. No. 4,177,856 and U.S. Pat. No. 4,144,926 issued to H. Liebermann disclose a method and apparatus in which a Reynolds number parameter is controlled to reduce edge defects in rapidly quenched amorphous strip. Gas densities and thus Reynolds numbers, are regulated by the use of vacuum and by employing lower molecular weight gases.

Conventional methods, however, have been unable to adequately reduce surface defects in cast metal strip caused by the entrapment of gas pockets. Vacuum casting procedures have afforded some success, but when using vacuum casting, excessive welding of the cast strip to the quench surface and the difficultly of removing the cast strip from the vaccum chamber have resulted in lower yields and increased production costs. As a result, conventional methods have been unable to provide a commercially acceptable process that efficiently produces smooth strip with consistent quality and uniform cross-section.

SUMMARY OF THE INVENTION

The invention provides an apparatus and method for efficiently casting smooth metal strip and substantially preventing the formation of gas pocket defects therein. The apparatus of the invention includes a moving chill body having a quench surface, and includes a nozzle means for depositing a stream of molten metal on a quenching region of the quench surface to form the strip. The nozzle means has a exit portion with a nozzle orifice. A depletion means heats a gas to lower the density thereof and to produce a low density atmosphere having a temperature of at least about 800° K. The gas is supplied to a depletion region located adjacent to and upstream of the quenching region to provide the low density atmosphere within the depletion region.

In accordance with the invention there is also provided a method for casting continuous metal strip. A chill body having a quench surface is moved at a selected speed, and a stream of molten metal is deposited on a quenching region of the quench surface to form the strip. A gas is heated to lower the density thereof and to produce a low density atmosphere having a temperature of at least about 800° K. The gas is supplied to a depletion region located adjacent to and upstream of the quenching region to provide the low density atmosphere within the depletion region and thereby substantially prevent formation of gas pockets in the strip.

The invention further provides a metal strip having a thickness of less than about 15 micrometers in the ascast state.

The method and apparatus of the invention advantageously minimize the formation and entrapment of gas pockets against the quenched surface during the casting of the strip. As a result, the invention avoids the needs for complex vacuum casting apparatus and can be practiced in an ambient atmosphere. The heated gas within the depletion region surprisingly provides better and more uniform cooling and quenching of the molten metal. The hot gas provides a low density atmosphere that inhibits the formation of gas pockets operating to decrease contact between the molten metal and the quench surface. The more uniform quenching, in turn, provides improved physical properties in the cast strip. In particular the reduction of surface defects on the quenched surface side of the strip increases the packing factor of the material and reduces localized stress concentrations that can cause premature fatigue failure. The smoothness of the free surface side of the cast strip (i.e. the side not in contact with the quench surface of the chill body) is also improved by the method and apparatus of the invention. This increased smoothness further increases the packing factor of the material. In production of amorphous metal strip, the more uniform quenching afforded by the low density atmosphere provides a more consistent and uniform formation of the amorphous state. In manufacture of strip composed of magnetic material, the number and size of strip surface discontinuities is reduced, improving the magnetic properties of the strip.

Surface defects due to entrapped gas pockets are reduced, and there is much less chance for a gas pocket to perforate the strip. Surprisingly, very thin strips (less than about 15 microns in thickness) have been produced. These very thin strips are highly desirable in various applications. For example, in magnetic devices, such as inductors, reactors and high frequency electromagnetic devices, thin magnetic material substantially reduces power losses therein. In brazing, the use of thinner brazing foils substantially improves the strength of the brazed joints.

Moreover, the reduction of entrapped gas pockets markedly increases the heat condutive contact between the molten metal and the quench surface. Thicker strips of rapidly solidified metal can be produced. Such thicker strip is desireable because it can be more easily substituted for materials conventionally used in existing commercial applications. These thick strip components can, surprisingly, be rovided by rapid solidification in a single quenching step in much less time waith decreased cost.

Thus, the present invention effectively minimizes gas pocket defects on the strip surface which contacts the quench surface, and produces strip having a smooth surface finish and uniform physical properties. Complex equipment and procedures associated with vacuum casting are eliminated. The invention efficiently casts ultra thin as well as extra thick metal strip directly from the melt at lower cost and with higher yield. Such ultra thin and extra thick strips are especially suited for use in such applications as magnetic devices and can be substituted fr conventional materials with greater effectiveness and economy.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF PREFERRED EMBODIMENTS

For the purposes of the present invention and as used in the specification and claims, a strip is a slender body the transverse dimensions of which are much smaller than its length. Thus, a strip includes wire, ribbon, sheet and the like of regular or irregular cross-section.

The invention is suitable for casting metal strip composed of crystalline or amorphous metal and is particularly suited for producing metal strip which is rapidly solidified and quenched at a rate of at least about $10^{4}$° C./sec from a melt of molten metal. Such rapidly solidified strip has improved physical properties, such as improved tensile strength, ductility and magnetic properties.

Figure 1:
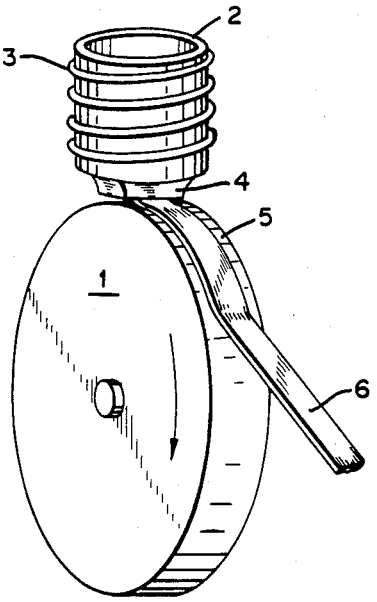
FIG. 1 shows a representative prior art apparatus for rapidly casting metal strip.

FIG. 1 shows a representative prior art device for rapidly casting continuous metal strip. Molten metal alloy contained in crucible 2 is heated by a heating element 3. Pressurization of the crucible with an inert gas forces a molten stream through a nozzle 4 at the base of the crucible and deposits the molten metal onto a moving chill body, such as rotatable casting wheel 1. Solidified moving strip 6, after its break-away point from the quench wheel is then routed onto a suitable winding means.

Quench surface 5 (substrate) is preferably a material having high thermal conductivity. Suitable materials include carbon steel, stainless steel and copper based alloys such as beryllium copper. To achieve the quench rates of at least about $10^{4}$° C. per second, wheel 1 is internally cooled and rotated to provide a quench surface that advances at a speed ranging from about 100–4000 meters per minute. Preferably, the quench surface speed ranges from about 200–3000 meters per minute. Typically, the thickness of the cast strip ranges from 25–100 microns (micrometers).

Figure 2:
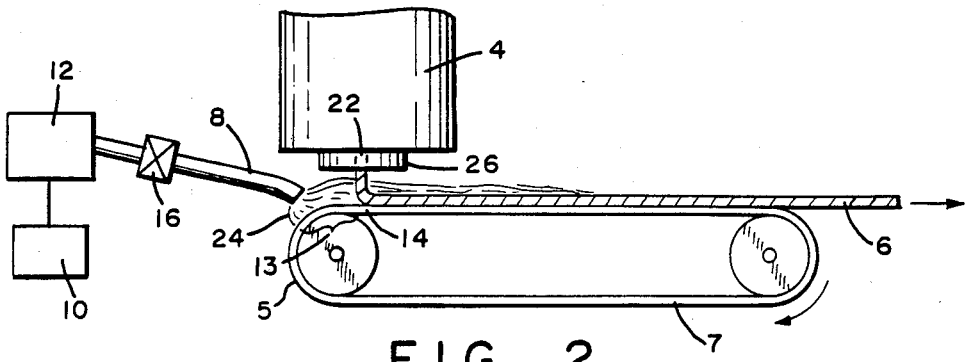
FIG. 2 shows a schematic representation of a embodiment of the invention which employs an endless casting belt.
Figure 3:
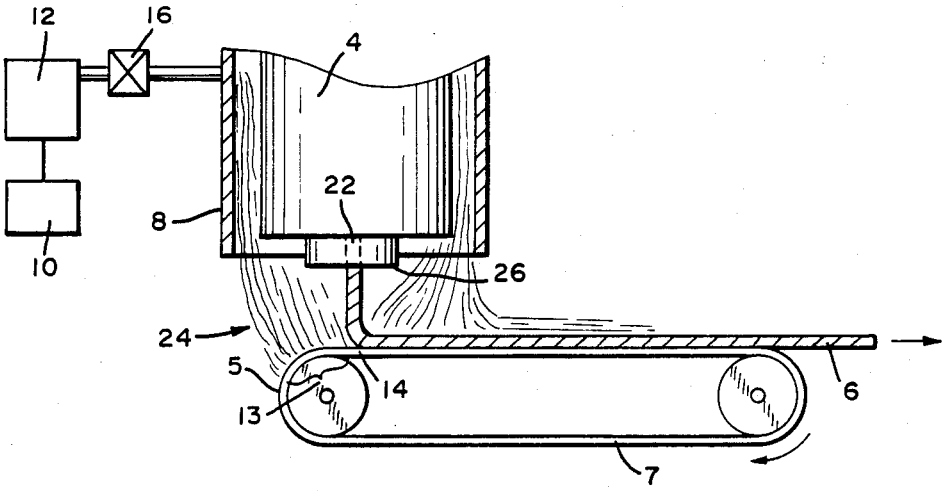
FIG. 3 shows an embodiment of the invention which employs a gas delivery means located coaxial with a casting nozzle.

FIG. 2 shows a representative apparatus of the invention. A moving chill body, such as endless casting belt 7, has a chilled casting quench surface 5. Nozzle means, such as nozzle 4, deposits a stream of molten metal onto a quenching region 14 of quench surface 5 to form strip 6. Nozzle 4 has an orifice 22 located at exit portion 26. A depletion means, including gas nozzle delivery means 8, heater means 10, and gas supply 12, heat a gas 24 from gas supply 12 to produce a low density atmosphere and directs the gas with gas nozzle 8 to a depletion region 13 located adjacent to and upstream from quenching region 14. Nozzle 8 is suitably located to direct gas 24 at and around the depletion region 13 so that the gas 24 substantially floods the depletion region 13, providing a low density atmosphere therewithin. Valve 16 regulates the volume and velocity through nozzle 8. As shown in FIG. 2, gas nozzle 8 is located upstream of quenching region 14 and is directed along the direction of movement of the quench surface. Optionally, gas nozzle 8 can be located coaxial with casting nozzle 4 as representatively shown in FIG. 3.

The term low density atmosphere, as used in the specification and claims hereof, means an atmosphere having a gas density less than 1 gram per liter and preferably, having a gas density of of less than about 0.5 grams per liter.

To obtain the desired low density atmosphere, gas 24 is heated to at least about 800° K., and more preferably, is heated to at least about 1300° K. In general, hotter gases are preferred because they will have lower densities and will better minimize the formation and entrapment of gas pockets between quench surface 5 and the deposited molten metal.

Entrapped gas pockets are undesirable because they produce ribbon surface defects that degrade the surface smoothness. In extreme cases, the gas pockets will cause perforations through strip 6. A very smooth surface finish is particularly important when winding magnetic metal strip to form magnetic cores because surface defects reduce the packing factor of the material. The packing factor is the volume fraction of the actual magnetic material in the wound core (the volume of magnetic material divided by the total core volume) is is often expressed in percent. A smooth surface without defects is also important in optimizing the magnetic properties of strip 6 and in minimizing localized stress concentrations that would otherwise reduce the fatique resistance of the strip.

Gas pockets also insulate the deposit molten metal from quench surface 5 and reduce the quench rate in localized areas. The resultant, non-uniform quenching produces non-uniform physical properties in strip 6, such as non-uniform strength, ductility and magnetic properties.

For example, when casting amorphous metal strip, gas pockets can allow undesired crystallization in localized portions of the strip. The gas pockets and the local crystallizations produce discontinuities which inhibit mobility of magnetic domain walls, thereby degrading the magnetic properties of the material.

Thus, by reducing the entrapment of gas pockets, the invention produces high quality metal strip with improved surface finish and improved physical properties. For example, metal strip has been produced with packing factors of at least about 80%, and up to about 95%.

Figure 6:
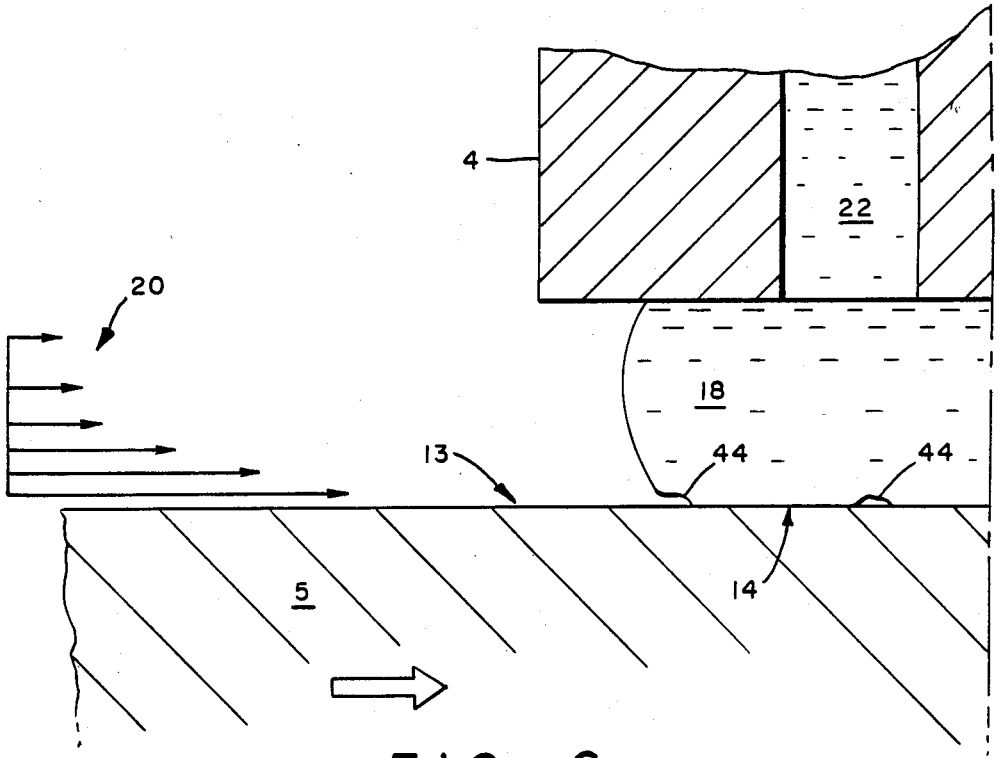
FIG. 6 shows a gas velocity profile at the quench surface portion on which molten metal is deposited.

The mechanism by which gas pockets are reduced can be more readily explained with reference to FIG. 6. The gas boundary layer velocity profile near quench surface 5 and upstream of melt puddle 18 is shown schematically at 20. The maximum gas boundary layer velocity occurs immediately adjacent to quench surface 5 (substrate) and is equal to the velocity of the moving quench surface. Thus, moving quench surface 5 ordinarily draws cool air from the ambient atmosphere into depletion region 13 and into quenching region 14, the region of the quench surface upon which molten metal is deposited. Because of the drafting of relatively cool air into the quenching region, the presence of the hot casting nozzle and the molten metal do not sufficiently heat the local atmosphere to significantly reduce the density thereof.

Melt puddle 18 wets the substrate surface to an extent determined by various factors including the metal alloy composition, the substrate composition, and the presence of surface films. The pressure exerted by the gas boundary layer at the melt-substrate interface, however, acts to locally separate the melt from the substrate and form entrained gas pockets which will appear as "lift-off" areas 44 on the ribbon underside. The stagnation pressure of the gas boundary layer (pressure if the layer hit a rigid wall) is given by the formula $P_s = \frac{1}{2} \rho v^2$ where: $\rho$=gas density, v=substrate velocity. Therefore, the reduction of gas boundary layer density or substrate velocity are important in the reduction of the size and the number of gas pockets entrained under the molten metal puddle. For example, removal of the gas boundary layer by casting in vacuum can totally eliminate the lift-off areas in the strip underside. Alternatively, a low density gas in the boundary layer could be employed. The selection of a low molecular weight gas (such as helium) is one way to reduce boundary layer gas density. However, the variety of low molecular weight gases which can be used in this fashion is quite limited. A preferred manner in which to reduce the boundary layer gas density is to use a heated gas; the density of the gas will diminish as the inverse of the absolute temperature. By directing the hot gas at the upstream side of the melt puddle 18, the size and the number of entrained gas pockets under the melt puddle can be substantially reduced.

It is important, however, to regulate pertinent factors, such as the composition of the hot, low-density atmosphere, and the parameters of quench surface 5, to substantially prevent the formation of any solid or liquid matter which could precipitate onto quench surface 5. Such precipitate, if entrained between the melt puddle and quench surface, could produce surface defects and degrade the strip quality.

Surprisingly, the heating of the gas atmosphere located proximate to quenching region 14 to decrease the density thereof does not degrade the quenching of the molten metal. To the contrary, the heating actually improves the uniformity of the quench rate by minimizing the presence of insulating, entrapped gas pockets, and thereby improves the quality of the cast strip.

Figure 4:
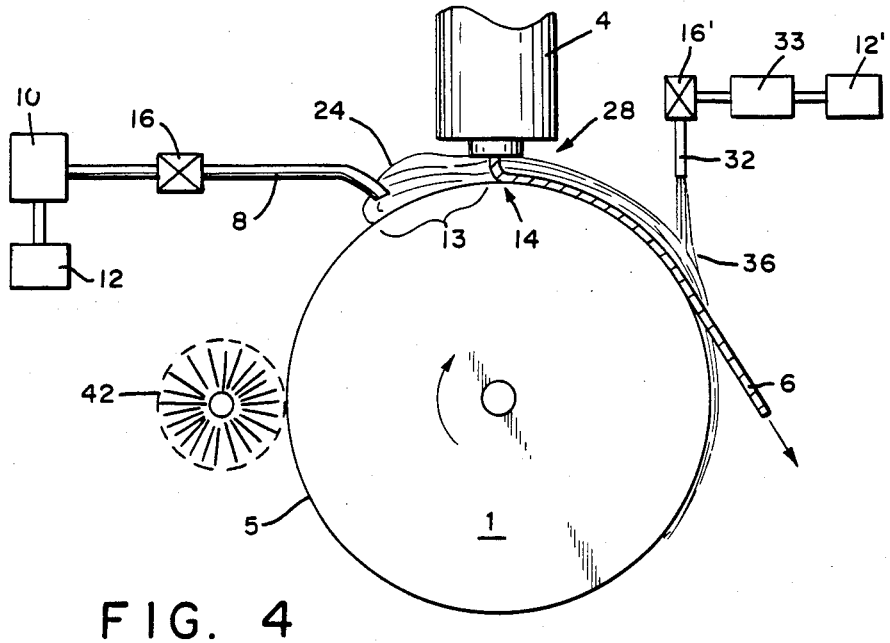
FIG. 4 shows an embodiment of the invention which employs a rotatable casting wheel.

Gases including nitrogen, helium, neon, argon krypton, xenon and mixtures thereof, have been found suitable for use in the present invention, provided such gases are heated to a temperature of at least about 800° K., and preferably 800°-1300° K., to reduce the density thereof. FIG. 4 shows an embodiment of the invention in which the aforesaid gases are supplied at low density by a depletion means. Nozzle 4 deposits molten metal onto quench surface 5 of rotating casting wheel 1 to form strip 6. The depletion means in this embodiment is comprised of gas supply 12, gas nozzle 8 and heater means 10. Valve 16 regulates the volume and velocity of gas delivered through gas nozzle 8, and a wiper brush 42 conditions quench surface 5 to help reduce oxidation thereon. Heater means 10 heats the gas to produce a heated, low-density atmosphere around depletion region 13 and around quenching region 14 where molten metal is deposited. As a result, a hot, low density atmosphere is located around quenching region 14 and for a distance on either side thereof. Optionally, additonal gas nozzels 32 and heater means 33 can be employed, together with gas supply 121 to provide additional atmospheres 36 along selected portions of strip 6 to further protect the strip from oxidation.

Figure 5:
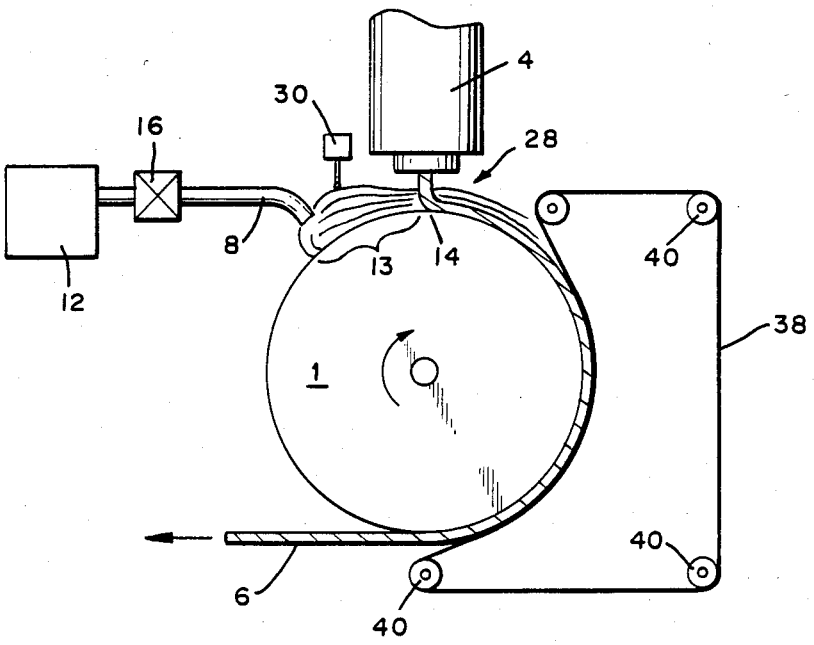
FIG. 5 shows an embodiment of the invention which employs a flexible hugger belt to prolong contact of the cast strip with the quench surface.

As shown in FIG. 5, the invention may optionally include a flexible hugger belt 38 which entrains strip 6 against quench surface 5 to prolong cooling contact therewith. The prolonged contact improves the quenching of strip 6 by providing a more uniform and prolonged cooling period for the strip. Guide wheels 40 position belt 38 in the desired hugging position along quench surface 5, and a drive means moves belt 38 such that the belt portion in hugging relation to quench surface 5 moves at a velocity substantially equal to the velocity of the quench surface. Preferably, belt 38 overlaps the marginal portions of strip 6 to directly contact and frictionally engage quench surface 5. This frictional engagement provides the required driving means to move the belt.

Considerable effort has been expended to develop devices and procedures for forming thicker strips of rapidly solidified metal because such strip can more easily be used as a direct substitute for materials presently employed in existing commercial aplications. Since the present invention significantly improves the contact between the stream of molten metal and the chilled quench surface, there is improved heat transport away from the molten metal. The improved heat transport, in turn, provides a more uniform and more rapid solidification of the molten metal to produce a higher quality thick strip, i.e. strip having a thickness ranging from about 15 micrometers to as great as about 70 micrometers and more.

Similarly, considerable effort has been expended to form thinner strips of rapidly solidified metal. Very thin metal strip, less than about 15 micrometers and preferably about 8 micrometers in thickness, is highly desirable in various commercial applications. In brazing applications, for example, the filler metals used in brazed joint normaly have inferior mechanical properties compared to the base metals. To optimize the mechanical properties of a brazed assembly, the brazed joint is made very thin. Thus, when filler material in foil form is placed directly in the joint area prior to the brazing operation, the joint strength can be optimized by using a very thin brazing foil.

In magnetic applications with high frequency electronics (over 10 kHz), power losses in magnetic devices are proportional to the thickness (t) of the magnetic materials. In other magnetic applications such as saturable reactors, power losses are proportional to the thickness dimension of the magnetic material raised to the second power ($t^2$) when the material is saturated rapidly. Thus, thin ribbon decreases the power losses in the reactor. In addition, thin ribbon requires less time to saturate; as a result, shorter and sharper output pulses can be obtained from the reactor. Also, thin ribbons decrease the induced voltage per lamination and therefrom, require less insulation between the laminations.

In inductors for linear induction accelerators, losses are again related to $t^2$, and the thinner ribbon will reduce power losses. Also, thin ribbon saturates more easily and rapidly and can be used to produce shorter pulse accelerators. In addition, the thinner ribbon will require reduced insulation between the laminations.

A further advantage of thin strip is that the strip experiences less bending stresses when wound to a given diameter. Excessive bending stresses will degrade the magnetic properties through the phenomenon of magnetostriction.

The apparatus and method of the invention are particularly useful for forming very thin metal strip. Since the invention significantly reduces the size and depth of gas pocket defects, there is less chance that such a defect will be large enough to perforate the cast strip. As a result, very thin strip can be cast because there is less probability that a defect large enough to perforate the strip will form. Thus, the invention can be adapted to cast very thin metal strip, which as-cast, is less than about 15 micrometers thick. Preferably, the cast strip has a thickness of 12 micrometers or less. More preferably, the cast strip thickness ranges from 7 to 12 micrometers. In addition, the thin metal strip has a width dimension which measures at least about 1.5 millimeters, and preferably measures at least about 10 mm.

EXAMPLES

A forced-convection-cooled, plain carbon steel substrate wheel is 38 cm (15 in.) in diameter, 5 cm (2 in.) wide. Initially, nickel-base ribbons of composition $Ni_{68}Cv_7Fe_3B_{14}Si_8$ (subscripts in atomic percent) are produced on the steel wheel with low circumferential surface speed (about 10 m/s or 2,000 fpm) to avoid excessive ribbon-substrate adhesion. The substrate wheel is conditioned continuously during the run by an idling brush wheel inclined about 10° out of the casting direction.

The ribbons exhibit very little adhesion on the substrate surface. An increase in casting pressure and an increase substrate surface speed help improve ribbon-substrate adhesion. All of the ribbons cast show significant populations of entrapped air pockets in the underside. A dark oxidation track, which forms on the substrate surface during ribbon casting, limits the ribbon to substrate-adhesion. A hot gas stream, directed at the ribbon casting track upstream of the melt puddle, reduces oxidation and promotes ribbon-substrate adhesion. The combined actions of the hot gas stream and the conditioning brush reduce the substrate oxidation, increase adhesion and produce ribbon having good geometric uniformity.

Thus, experiments show a remarkable improvement of ribbon surface smoothness, luster, and ductility over material cast in a conventional manner. Such a defect-free casting capability allows the production of very thin ribbon (on the order of about 7 micrometers thick). Additionally, the improved melt-substrate contact caused by casting in a hot gas stream improves overall quench rate and enables the production of a given ribbon composition at a thickness greater than usual.

Having thus described the invention in rather full detail, it will be understood that such detail need not be strictly adhered to heat that various changes and modifications may suggest themselves to one skilled in the art, all falling within the scope of the present invention, as defined by the subjoined claims.

We claim:

1. An apparatus for casting metal strip, comprising:

(a) a moving chill body having a quench surface;

(b) nozzle means for depositing a stream of molten metal on a quenching region of said surface to form said strip; and (c) depletion means for supplying a low density atmosphere comprised of a gas at a depletion region located adjacent to and upstream from said quenching region, said depletion means including heater means for heating said gas to a temperature of at least about 800° K. to produce said atmosphere, whereby formation of pockets in said strip is substantially prevented.

2. An apparatus as recited in claim 1, further comprising means for providing at least one additional atmosphere located along a portion of said strip.

3. An apparatus as recited in claim 2, wherein said additional atmosphere has a temperature of at least about 800° K.

4. An apparatus as recited in claim 1, wherein said gas is selected from the group consisting of nitrogen, helium, neon, argon, krypton, xenon and mixtures thereof.

5. An apparatus as recited in claim 1, further comprising a flexible hugger belt which entrains said strip against said quench surface to prolong contact therewith.

6. An apparatus as recited in claim 1, wherein said chill body is a casting wheel which has an annular, peripheral quench surface and is rotatable about a concentric axis of rotation.

7. An apparatus as recited in claim 1, wherein said chill body is an endless casting belt.

8. A method for casting metal strip, comprising the steps of:

(a) moving a chill body having a quench surface at a selected speed;

(b) depositing a stream of molten metal on a quenching region of said quench surface to form said strip;

(c) heating a gas to lower the density thereof and produce a low-density atmosphere having a temperature of at least about 800° K.; and (d) supplying said gas to a depletion region located adjacent to and upstream of said quenching region to provide said low density atmosphere within said depletion region.

9. A method as recited in claim 8, further comprising the step of providing an additional atmosphere along a selected portion of said strip.

10. A method as recited in claim 8, wherein said gas is selected from the group consisting of nitrogen, helium, neon, argon, krypton, xenon and mixtures thereof.

11. A method as recited in claim 8, further comprising the step of entraining said strip against said quench surface to prolong contact therewith.

* * * * *